United States Patent [19]

Raab

[11] 4,312,093

[45] Jan. 26, 1982

[54] WINDOW CLEANING DEVICE

[76] Inventor: Hans Raab, Birkenallee 9, D-6602 Dudweiler, Fed. Rep. of Germany

[21] Appl. No.: 82,627

[22] Filed: Oct. 9, 1979

[30] Foreign Application Priority Data

Oct. 11, 1978 [DE] Fed. Rep. of Germany ..... 2844185

[51] Int. Cl.[3] ..... A47L 1/15

[52] U.S. Cl. ..... 15/121; 15/220 R; 15/245

[58] Field of Search ..... 15/104.94, 114, 117, 15/118, 121, 209 R, 210 R, 220 R, 221, 235, 223, 225

[56] References Cited

U.S. PATENT DOCUMENTS

| | | | |
|---|---|---|---|
| 629,835 | 8/1899 | Wertsbaugher | 15/121 |
| 1,179,918 | 4/1916 | Hayden . | |
| 1,459,071 | 6/1923 | Mumaw . | |
| 2,625,700 | 1/1953 | Baldwin | 15/121 |
| 2,842,789 | 7/1958 | Wells | 15/121 |
| 3,246,357 | 4/1966 | Ammons . | |
| 3,783,469 | 1/1974 | Siemund | 15/220 R X |

FOREIGN PATENT DOCUMENTS

| | | |
|---|---|---|
| 7624706 | 1/1977 | Fed. Rep. of Germany . |
| 7638436 | 8/1977 | Fed. Rep. of Germany . |

*Primary Examiner*—Edward L. Roberts

*Attorney, Agent, or Firm*—Toren, McGeady & Stanger

[57] ABSTRACT

A window cleaning device includes a moistening member, a wiper blade and a handle, all of which are secured to a body member. The moistening member consists of a number of layers of a permeable skin which is wound without a core for holding a cleaning liquid, the skin having hair thereon for breaking a dirt film on a surface to be cleaned. The moistening member fits within a concave surface portion on the body member, the body member having a projecting edge extending longitudinally beneath the moistening member to prevent liquid from being discharged downwardly and wasted while the device is operated. The amount of liquid which can be held by the moistening member is thereby substantially increased.

10 Claims, 10 Drawing Figures

WINDOW CLEANING DEVICE

BACKGROUND OF THE INVENTION

The present invention relates to window cleaning devices, and particularly to such devices including an elongated moistening member which stores or holds cleaning liquid to be applied on a surface to be cleaned, and a wiper blade arranged to wipe the liquid after it is deposited on the surface by the moistening member.

A known window cleaning device has a rear sectional or body member which has a replaceable and laterally slidable wiper blade fastened on one side and an elongated, skin-like moistening member extending in the same direction as the blade. A handle is fastened on the other side of the body member. This device is disclosed in German Utility Model Application No. 76 24 786.

The known window cleaning device has a disadvantage in that, although the moistening member consists of a hide or skin which is not described in detail, this skin is arranged only in a single layer on a support bar. Such a thin layer of skin can store only a small amount of water or other cleaning liquid. Furthermore since the skin is substantially exposed, there is the additional danger that the cleaning liquid can run down a window pane and soil the window sill during operation of the device. It is difficult to fasten the skin in the known window cleaning device since the skin, which is of tube like construction, must be pulled onto the bar. In this regard, it remains unclear how the rear body member can be fastened to the skin by extending through it.

An object of the present invention is to provide a window cleaning device wherein a moistening member can be easily and quickly fastened to a body member of the device.

Another object of the present invention is to provide a window cleaning device wherein the moistening member has a large cleaning liquid absorbing and storing capability without presenting the danger of soiling surrounding areas, such as a window sill, with the liquid.

Yet another object of the present invention is to provide a window cleaning device having a moistening member which is capable of effectively breaking up dirt and grease films on window panes or other surfaces to be cleaned.

In accordance with the present invention, a window cleaning device comprises an elongated moistening member which consists of a plurality of layers of a permeable skin wound without a core for holding a cleaning liquid. The skin has hair thereon of sufficient hardness to break a dirt film on a surface to be cleaned. An elongated body member has a concave surface portion extending longitudinally thereon to receive the moistening member, the concave surface portion having a projecting edge arranged to extend beneath the moistening member to prevent liquid from being discharged downwardly from the moistening member when the device is operated.

Preferably, the window cleaning device of the present invention is arranged so that the moistening member is releasably fastened to the body member by a band of burrs on the body member, zippers or push buttons. The moistening member can also be glued to the body member or fastened to it by screw members.

Also, the body member with a wiper blade thereon is preferably held to a handle by a single clamping screw, the handle being provided with an elongated opening at one end thereof through which the screw extends. This arrangement allows the handle to be positioned laterally of the body member before the clamping screw is tightened.

The following advantages are achieved with the window cleaning device of the present invention. First, the plastic skin, which is wound without a core, is capable of effectively storing large amounts of cleaning liquid. This is so because several layers of the absorbent skin are provided and, if a supporting layer or sheet to which the skin is bonded is also of an absorbent material, a significantly large amount of liquid can be stored by the moistening element. Second, with the hair of the skin being of sufficient hardness, the skin will be capable of effectively breaking up dirt and grease film on a window pane. Third, by placing the wound plastic skin on a concave surface portion of the body member, a configuration which lends itself to a simple fastening arrangement is provided and, further, the provision of the projecting edge on the concave surface portion, which is beneath the moistening member during operation of the device, effectively increases the liquid storage capability of the moistening member skin since the liquid cannot be easily discharged downwardly from the member and be wasted.

The moistening member can either be releasably or permanently mounted on the body member. Furthermore, the entire device can be held together by a single clamping screw, and the handle can be positioned laterally of the body member to facilitate effective cleaning of window panes or surfaces behind radiators and the like.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DESCRIPTION OF THE INVENTION

Figure 1:
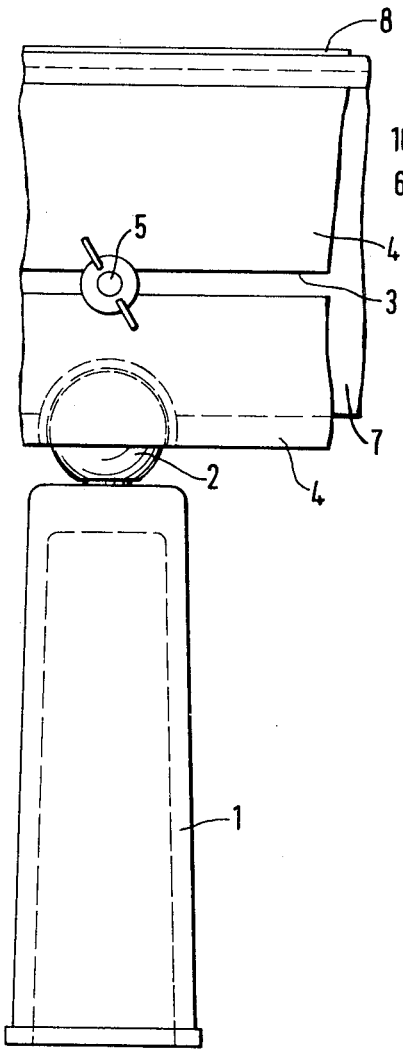
FIG. 1 is a partial rear elevational view of the window cleaning device according to the present invention.
Figure 2:
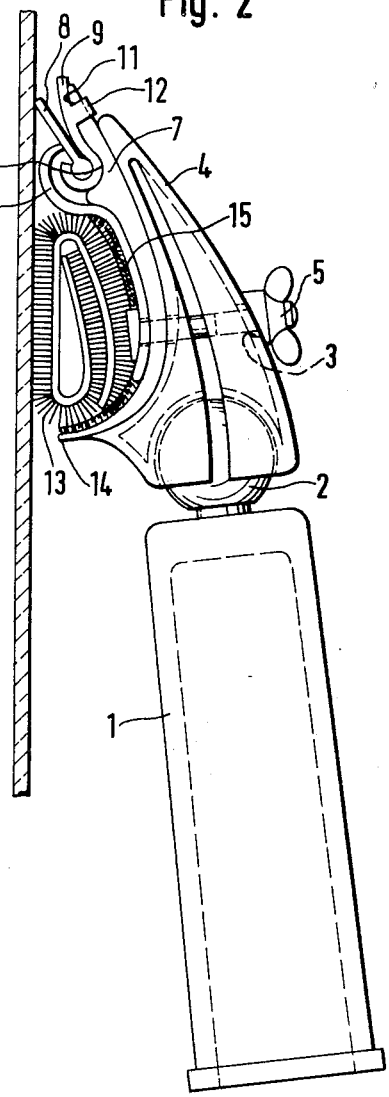
FIG. 2 is a side elevational view of the device in FIG. 1, the device being positioned against a surface to be cleaned.

Referring to FIGS. 1 and 2, the window cleaning device of the present invention includes a handle having a grip 1, including a ball 2 at one end of the grip which pivotally engages an elongated clamping member 4 forming the upper portion of the handle. This pivotal connection enables the device to be used in any chosen position.

A slot or elongated hole 3 is provided in the clamping member 4 of the handle thereby making it possible to shift the handle laterally of the device, as explained further below. It is therefore possible to clean surfaces behind obstacles such as radiators and the like without effort.

A clamping screw 5 extends through openings in a wiper blade fixing claw 6 and a body member 7, and the opening 3 in the clamping member 4. When the screw 5 is tightened, it will be understood that the pivotal joint between the ball 2 and the clamping member 4 is tightened, and the wiper blade fixing claw 6 is urged against the central region of the body member 7. A wiper blade 8 with an associated support member 9 is inserted between two curvilinear lips 10,11 formed at the top of the body member 7. One or more upper points on the wiper blade fixing claw 6 contact the wiper blade 8, as shown in FIG. 2.

Wiper support member 9 can be held in position, for example by bending free ends 12 of the wiper support member 9 over the body member 7.

Figure 3:
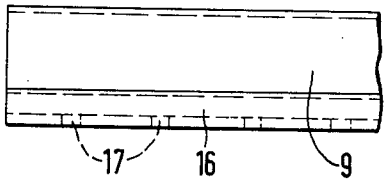
FIG. 3 is a partial front view of one form of wiper blade support member for use in the device of FIG. 1.
Figure 4:
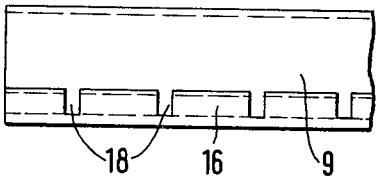
FIG. 4 is a partial front view of another form of wiper blade support member for use in the device of FIG. 1.
Figure 5:
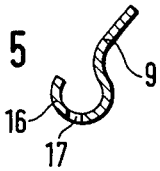
FIG. 5 is a sectional view through the support member of FIG. 3.
Figure 6:
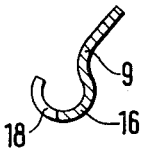
FIG. 6 is a sectional view through the support member of FIG. 4.

The wiper blade 8 frequently moves large amounts of water or other liquid transferred from the window cleaning device of the present invention to a surface to be cleaned. Referring to FIGS. 3–6, it will be understood that this excess liquid will be directed by the blade 8 into a lower rounded portion 16 of the support member 9, the portion 16 being formed to receive and engage a correspondingly rounded portion on the wiper blade 8. The liquid tends to collect in the support member portion 16 and, particularly when working rapidly with the device, will be flung outwardly from the sides of the support member 9. In order to prevent this undesirable result, the rounded portion 16 is provided either with spaced apart openings 17 along the lower edge of the rounded portion 16, as shown in FIGS. 3 and 5, or with spaced apart recesses 18 provided in an upper lip of the rounded portion 16 as shown in FIGS. 4 and 6. Accordingly, excess liquid which has been wiped off of a surface by the blade 8 can flow through the openings 17 or recesses 18 into direct contact with a moistening member 13 arranged therebelow, and be collected by the moistening member 13 where it can be safely accumulated.

Body member 7 has a concave surface portion for receiving the moistening member 13. This surface portion has an edge 14 which extends longitudinally of the member 7 and projects in an arch-like manner so as to serve as a deflector or guard against liquid dropping from the moistening member 13, and to reinforce the liquid storage capability of the moistening member 13.

The moistening member 13 consists of a liquid permeable skin or fabric roll with bristles or hair which are hard enough to break up greasy dirt film on a window pane or other surface to be cleaned. Releasable fastening of the moistening member 13 on the body member 7 can be effected by a band of burrs 15 on the body member 7, as shown in FIG. 2. Also, the moistening member 13 can be releasably fastened to the body member 7 by way of zippers, screws, push buttons, or other conventional means so that the moistening member 13 can be replaced. If desired, the moistening member can also be glued to the body member 7.

Figure 7:
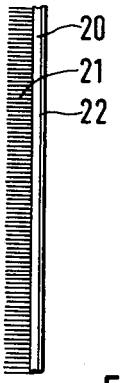
FIG. 7 is a side view of fabric of which a moistening member in the device of FIG. 1 is wound.

In further detail, FIG. 7 illustrates the material of which the moistening member 13 is formed, the material including a base or backing fabric 20 made of plastics material such as polypropylene (Meraklon-Bayer), cotton or the like. Base fabric 20 is produced on a circular knitting machine, and a web or pile layer 21 is simultaneously knitted onto the fabric 20. The layer 21 can be of polyester (Vestan 16-Bayer), for example, or a similarly firm material. The individual hairs of the web layer 21 are sufficiently stiff so that they are able to break up film or dirt on the surface to be cleaned. The side of the base fabric facing opposite the web layer 21 can be stabilized so as to be water permeable by means of a finish or dressing of rubber, plastics material or the like.

Figure 8:
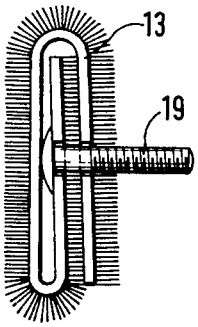
FIG. 8 is a side, sectional view of the wound moistening member including a fastening screw.
Figure 9:
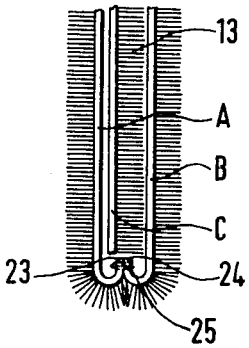
FIG. 9 is a sectional view of one end portion of the moistening member, looking downwardly at the member as viewed in FIG. 8 and showing two lateral edges stitched together.
Figure 10:
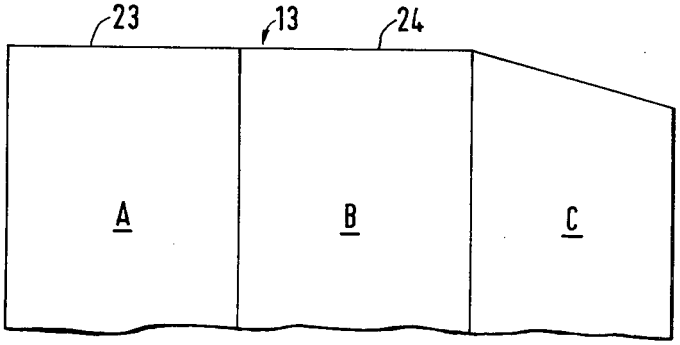
FIG. 10 is a diagrammatic representation of the shape of the moistening member when cut to size, prior to being wound and stitched as shown in FIGS. 8 and 9.

The moistening member material is then wound as shown in FIGS. 8–10, the two lateral ends of the moistening member 13 being closed off by means of a seam 25 which connects inwardly folded sides 23,24 of the material portions A and B. The inner portion C of the moistening member material is cut along a slant at its lateral ends FIGS. 9 and 10 show one lateral end portion to enable the folded portions A and B to be sewn at their inwardly folded sides 23,24. While two folds of the moistening member material have been shown and described, it will be understood that moistening member 13 may also consist of a lesser or greater number of layers or folds than described herein. FIG. 8 illustrates the use of a screw member 19 which extends from the interior of the folded moistening member 13 to pass through openings in the folded portions C and A of the moistening member material, and projects outwardly and in a transverse direction relative to the moistening member 13 to facilitate mounting of the member 13 on the body member 7. Members can be provided through openings in the body member 7 for engaging the screw members 19 and securing the moistening member 13 on the body member.

While specific embodiments of the invention have been shown and described in detail to illustrate the application of the inventive principles, it will be understood that the invention may be embodied otherwise without departing from such principles.

What is claimed is:

1. A window cleaning device comprising an elongated body member having a concave surface portion extending longitudinally on one side thereof, said surface portion having an edge which extends in the long direction of said body member, an elongated moistening member mounted on said concave portion for holding a cleaning liquid, said moistening member being formed of a liquid permeable material which is convolutely wound into an elongate shape, said liquid permeable material comprising a base layer and a pile layer secured to said base layer, said pile layer including hairs thereon of sufficient hardness to break dirt film on a surface to be cleaned by said device, a wiper blade detachably mounted to said body member for wiping liquid transferred from said moistening member onto the surface to be cleaned, said blade extending in the long direction of said body member, and a handle extending from said body member to enable said moistening member and said wiper blade to be operatively drawn over the surface to be cleaned wherein said edge contacts and forms a partial support for said moistening member to prevent liquid from being discharged downwardly therefrom, thereby increasing the amount of liquid which can be stored by said moistening member.

2. A window cleaning device according to claim 1, further including a band of burrs on said concave surface for releasably fastening said moistening member thereon.

3. A window cleaning device according to claim 1, wherein said moistening member is glued to said body member.

4. A window cleaning device according to claim 1, further including claw means for fixing said wiper blade relative to said body member, and a clamping screw extending through openings in said body member, said claw means and said handle for securing said claw means and said handle to said body member.

5. A window cleaning device according to claim 4, wherein the opening in said handle is elongated to extend in the long direction of said body member, and said clamping screw extends through said elongated opening so that said handle can be positioned relative to the long direction of said body member before said clamping screw is tightened.

6. A window cleaning device according to claim 1, further including screw members extending through said moistening member for mounting said moistening member on said body member.

7. A window cleaning device according to claim 1, further including an elongated support member having a lower rounded portion extending in the long direction of said support member for engaging said blade, said lower portion having a plurality of spaced apart openings therein for directing liquid collected by said blade onto said moistening member.

8. A window cleaning device according to claim 1, further including an elongated support member for mounting said wiper blade to said body member, said support member having a lower rounded portion including a lip extending in the long direction of said support member for engaging said blade, said lip having a plurality of spaced apart recesses therein for directing liquid collected by said blade onto said moistening member.

9. A window cleaning device according to claim 1, wherein said pile layer comprises polyester.

10. A window cleaning device according to claim 1, wherein said handle comprises an elongated grip including a swivel ball on one end of the grip, and an elongated clamping member arranged to support said body member and to pivotally engage said ball medially of the ends of said clamping member so that said grip can be swivelled to a desired positioned relative to said clamping member.

* * * * *